US005705030A

United States Patent [19]

Gassner, III et al.

[11] Patent Number: 5,705,030

[45] Date of Patent: Jan. 6, 1998

[54] FIBER AND FIBER PRODUCTS PRODUCED FROM FEATHERS

[75] Inventors: George Gassner, III, Laurel, Md.; Walter Schmidt, Washington, D.C.; Michael J. Line, Beltsville, Md.; Clayton Thomas, Baltimore, Md.; Rolland M. Waters, Gaithersburg, Md.

[73] Assignee: The United States of America as represented by the Secretary of Agriculture, Washington, D.C.

[21] Appl. No.: 471,349

[22] Filed: Jun. 6, 1995

Related U.S. Application Data

[63] Continuation-in-part of Ser. No. 175,077, Dec. 29, 1993, abandoned.

[51] Int. Cl.[6] ..... D01B 3/00

[52] U.S. Cl. ..... 162/2; 162/1; 162/60; 162/72; 162/158; 162/78; 162/151; 8/94.1; 8/127.5; 19/4

[58] Field of Search ..... 162/1, 2, 60, 72, 162/77, 78, 151, 158; 8/94.1 R, 127.5; 34/280, 281; 19/1, 2, 4

[56] References Cited

U.S. PATENT DOCUMENTS

| | | | |
|---|---|---|---|
| 328,680 | 10/1885 | Holden | 19/4 |
| 1,583,822 | 5/1926 | Yaffe | 19/4 |
| 2,501,184 | 3/1950 | Michaels et al. | 8/10 |
| 2,657,432 | 10/1953 | Naab | 19/4 |
| 2,706,143 | 4/1955 | Florio | 8/94.1 |
| 2,714,767 | 8/1955 | Frederick et al. | 34/2 |
| 2,805,914 | 9/1957 | Frederick et al. | 34/2 |
| 2,809,400 | 10/1957 | Maltenfort | 19/4 |
| 3,384,445 | 5/1968 | Gilbert | 8/142 |
| 3,475,112 | 10/1969 | Mahall | 8/94.1 |
| 4,169,706 | 10/1979 | Kruchen | 8/94.1 R |

FOREIGN PATENT DOCUMENTS

| | | |
|---|---|---|
| 2532158 | 1/1977 | Germany . |
| 32 24 028 A1 | 12/1983 | Germany . |

OTHER PUBLICATIONS

Morrow, M., "Frocks from Feathers", *Science News Letters* (1945).

*Primary Examiner*—Donald E. Czaja
*Assistant Examiner*—Jose S. Fortuna
*Attorney, Agent, or Firm*—M. Howard Silverstein; John Fado; Janelle S. Graeter

[57] ABSTRACT

A wide variety of end products may be manufactured from fibers or fiber pulp derived from feathers. Examples of such end products are paper and paper-like products, non-woven and woven fibers, insulation, filters, extrusions, and composite sheets and plates.

35 Claims, 5 Drawing Sheets

FIBER AND FIBER PRODUCTS PRODUCED FROM FEATHERS (This is a continuation-in-part of application Ser. No. 08/175,077, filed Dec. 29, 1993 now abandoned, herein incorporated by reference.)

BACKGROUND OF THE INVENTION

1. Field of the Invention

With the advent of increased poultry consumption both in the United States and abroad, increased poultry production has resulted in a concomitant increase in the amount of waste products for disposal by poultry producers. This invention relates to an article of manufacture and a manufacturing process which utilizes one of these waste products, feathers, in the production of fiber. The fiber is subsequently utilized in a wide-ranging variety of end products.

2. Description of the Prior Art

Currently, feathers are a waste product for which disposal is difficult. For example, the feathers may be hydrolyzed, then dried and ground to a powder to be used as a feed supplement for a variety of livestock, primarily chickens. It is a fairly expensive process, however, and results in a protein product of low quality for which the demand is low. Other disposal means such as burning or burying are also occasionally utilized, but these methods are considered environmentally unsound and are therefore largely prohibited.

There have been no reports of any useful products manufactured from feathers or of any other useful purpose which they might serve. Therefore, the instant invention not only provides novel products and procedures but also solves an environmentally sensitive problem of waste disposal.

Recognizing feather waste as a potential source of useable fiber, studies were begun to demonstrate and develop that usefulness by making commercially viable products. The initial project involved making paper from feather fiber pulp, which provided an additional environmental advantage. The increasing fiber demand by paper product users has placed a great demand on plant resources since paper products are composed primarily of cellulose. Generally paper pulp is prepared from plants by mechanically and/or chemically macerating the plant form to yield its component fibers which are subsequently collected and processed into pulp. The pulp is then utilized for the production of paper and paper products. Therefore, in addition to alleviating a significant waste management problem, the invention also provides a means for reducing the pressure on forests as the sole source of the raw materials needed for the myriad paper products manufactured today. The invention provides an alternative source of these materials with considerably less waste and processing than occurs from wood-based sources. With a shift to feather utilization for useful products, feathers become a major poultry by-product instead of an environmentally difficult disposal problem.

SUMMARY OF THE INVENTION

We have discovered a method of utilizing feathers to make fibers and fiber pulp, useful for the manufacture of a wide variety of end products. In accordance with this discovery it is an object of the invention to provide a method of making fibers and fiber pulp from feathers.

It is an additional object of the invention to provide novel fiber and fiber products derived from feathers.

Other objects and advantages of the invention will become readily apparent from the following description.

DETAILED DESCRIPTION OF THE INVENTION

Feathers can be utilized to make fibers which are an alternative to existing fiber types such as cellulose, silk and organic polymers. A wide variety of products may then be produced by utilizing the fibers either alone or in formulations with other fibers to form the raw material for the manufacture of a variety of end products including, but not limited to, insulation, fabrics and filters. The fibers can be strengthened by the addition of adhesives, binders, sizing agents and otherwise modified by other additives such as dyes, mordants, whiteners or redox reagents. The fibers of the invention are advantageous because of their ready availability and natural abundance. In addition, physical properties of fibers or fiber mixtures are easily varied according to the length or composition of the fibers or fiber mixtures. For example, structurally, feather fibers have naturally-occurring nodes approximately 50 microns apart. These nodes are potential cleavage sites for producing fibers of uniform 40–50 μm lengths. In addition, feathers from different species vary in length: poultry feather fibers are approximately 2 cm in length while those derived from exotic birds such as peacocks or ostriches are 4 to 5 cm or longer. Feather fibers are also thinner than other natural fibers resulting in products having a smooth, fine surface.

Feathers from any avian species may be utilized since feathers from all avian sources have the characteristics which are necessary for the production of useful fibers. Feathers are made up of many slender, closely arranged parallel barbs forming a vane on either side of a tapering hollow shaft. The barbs have bare barbules which in turn bear barbicels commonly ending in hooked hamuli and interlocking with the barbules of an adjacent barb to link the barbs into a continuous vane. Feather waste consists of insoluble fiber, soluble protein, fat and water. The insoluble fiber portion of the feather consists primarily of the proteins keratin and collagen.

Figure 1:
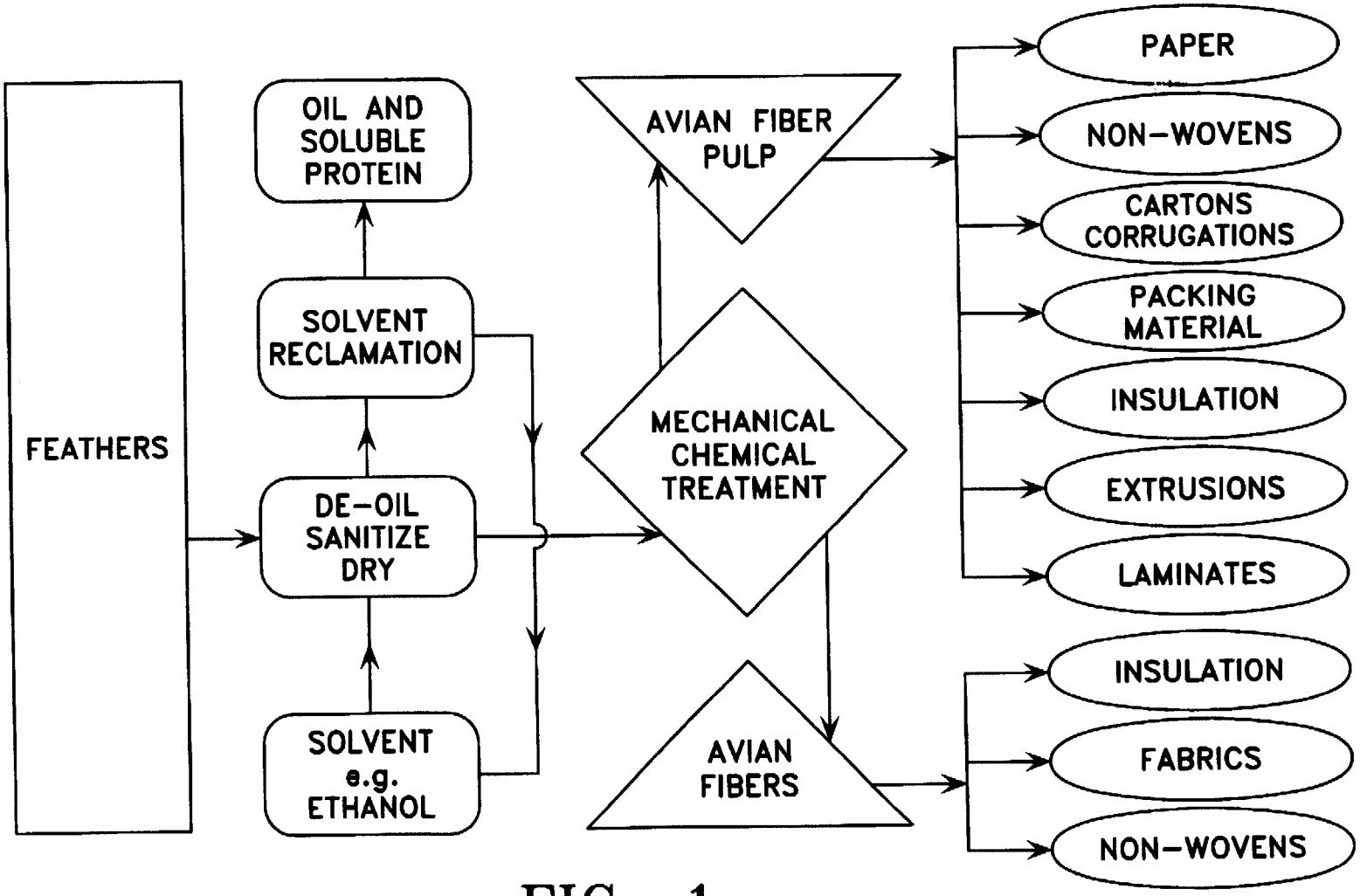
FIG. 1 is a schematic drawing showing the basic steps of making fibers from feathers and some uses for the fiber and fiber pulp compositions.

While not wishing to be bound by any particular treatment method, feathers treated according to the scheme presented in FIG. 1 are effective for use in the production of fibers useful according to the invention. Feathers from any avian source are useful in the practice of the invention; however, since chickens are the major source of currently available feathers, the invention will be described with respect to chicken feathers.

The method comprises five basic steps:

a) collecting raw feathers, b) washing the feather in an organic solvent, c) repeating the washing step, d) drying the feathers and e) removing fibers from feather shafts.

After collection, raw feathers are treated to remove oil or fat as well as to sanitize and partially dehydrate the fibers. Washing with agitation is carried out in an organic solvent, preferably a polar organic solvent such as about 95% ethanol, for about one hour, in approximately 1.0 to 1.5 gallons of solvent per pound of feathers. Lower solvent/solid ratios with more efficient agitation may be adjusted as deemed necessary for effective oil removal. In addition, a surfactant, such as polysorbate 80, may also be included in the wash solution at about 0.5% (v/v).

After removal from the first solvent, a second wash step is carried out to remove soluble protein and to further sanitize the feathers. Washing in an ethanol wash (about 70%) or other organic solvent or bactericidal agent (e.g., a sodium azide solution) and/or mixture, in approximately 1.0 to 1.5 gallons solvent per pound feather waste, for about an hour has been found effective. The feathers are then drained or otherwise separated from the solvent. Any residual solvent is removed by drying, such as in a forced air oven at a temperature range of about 60° to about 120° C. for about 6 hours, depending on the efficiency of the oven. Other comparable drying techniques may also be utilized.

Following the washing steps, fibers are removed from the feather shaft using mechanical shredding or shearing. Fiber length, particle size and particle distribution criteria determine which of the proper shredding devices should be used. For example, linters produce long fibers (about 2.5 cm), Waring blenders produce medium length fibers (about 1.5 cm), and Wiley mills produce a range of short fiber lengths (<1.5 cm). The use of these devices for the preparation of fibers from other sources is well-known and within the level of ordinary skill in the art. They may be utilized for the preparation of fibers from feathers with little or no modification in known procedures.

In a preferred embodiment, the fiber is removed from the shaft using a high speed constant flow centrifugal grinder, such as a Brinkmann Centrifugal Grinding Mill (Brinkmann Instruments, Inc., Westbury, N.Y.). Prior to grinding, feathers may be fed through a mulcher or chopper in order to shorten longer fibers, thereby increasing the speed and efficiency of the grinder. Feathers are fed into a grinding chamber which has a rotor spinning within a screen with large holes. The rotor has teeth spaced sufficiently far apart that the fibers may pass first through the spaces between the teeth on the rotor, then through the holes in the screen, the diameter being the approximate maximum fiber length. The ground mixture of feather fibers and shaft particles are driven through the screen by centrifugal force. Processing of the feathers in the grinder results in a mixture which can be fed into one or more separators to separate the fibers from the mixture.

Figure 2:
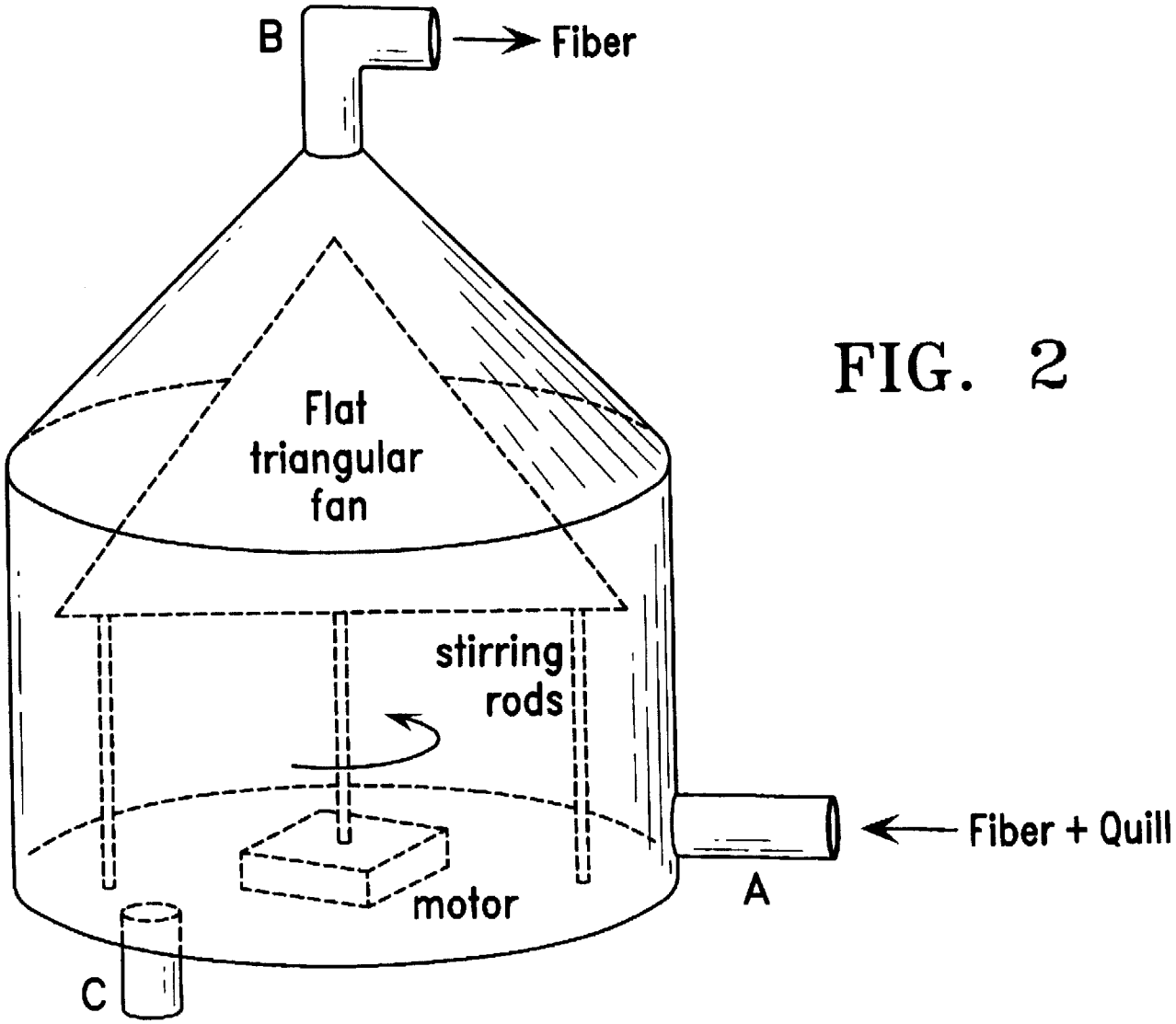
FIG. 2 is a drawing of a cone separator having a cylindrical base with a cone-shaped cover through which separated fibers may exit.

The feather fibers and shafts may be separated using linters (as described by Temming and Grunert. *Temming-Linters: Technical Information on cotton Cellulose*. 1973. Peter Temming AG, Gluckstadt, herein incorporated by reference) or other mechanical separation techniques depending on the ultimate use of the fibers, as illustrated in FIGS. 2, 3 and 4. The presence of shaft material in the mixture provides a more granular, bulkier, light-weight material, such as would be preferable for fillers. On the other hand, its removal results in smoother, denser products.

In the cone separator, illustrated in FIG. 2, the ground mixture of feather fibers and shaft particles is fed by air pressure through the inlet at A at the base of the cylindrical structure. The mixture is then accelerated around the base of the cylinder until the fiber portion of the mixture reaches equilibrium in the vertical direction, i.e. the force of gravity and the downward drag force is balanced by the upward air flow (drag force is defined herein as resistance to air flow). Separation occurs when the drag force is less than the force necessary to lift the shaft particles: the lighter fibers rise upward into the cone portion of the separator and are forced out of the separator through outlet B while the heavier shaft particles either remain in the cylinder portion or, if they reach the cone, the larger particles are pushed out and down the side walls by centripetal force. An optional outlet port C is provided for recycling shaft particle portions containing fibers not separated out during the process.

Figure 3A:
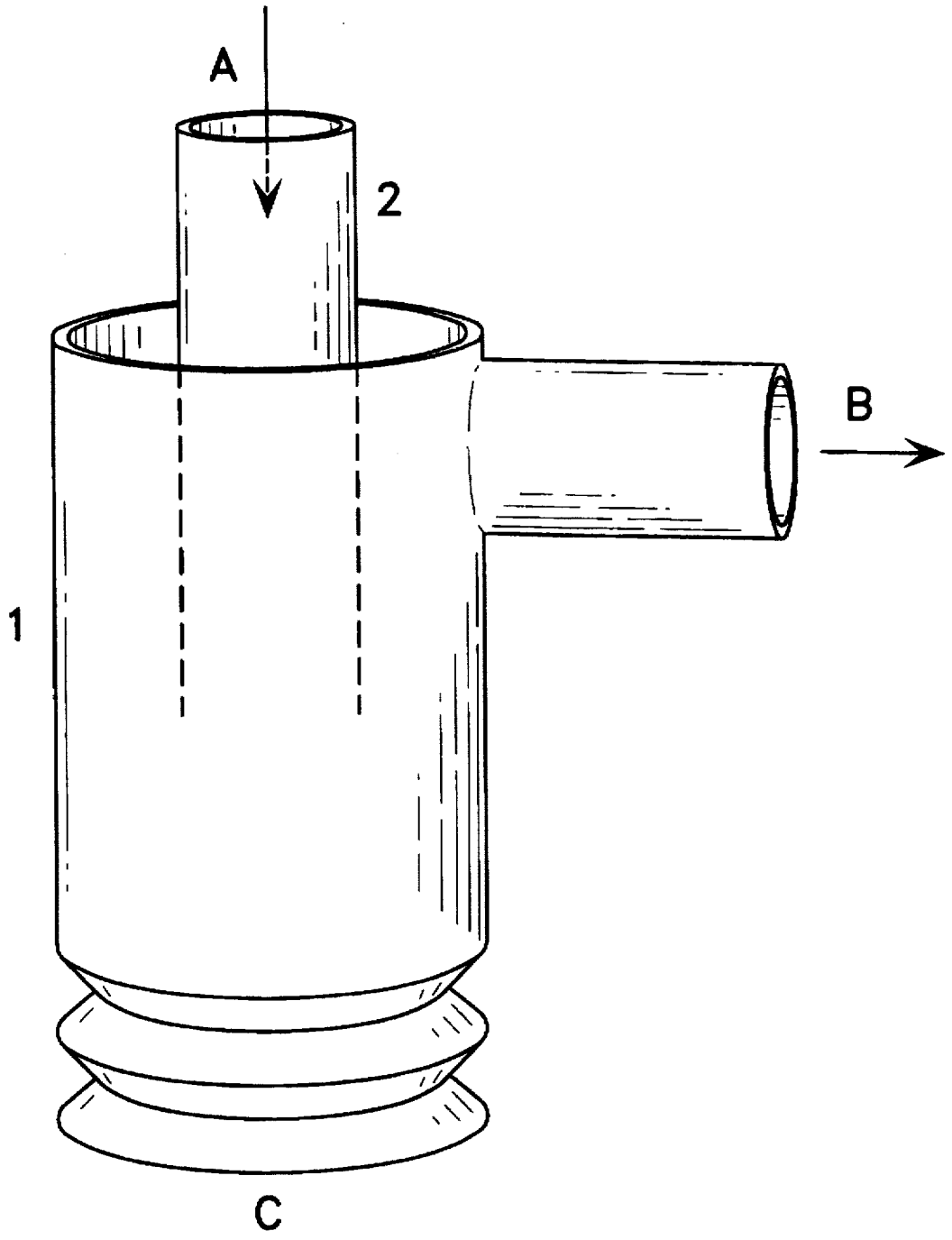
FIG. 3 is a drawing of A) an organ separator having an inner input tube concentric with an outer cylinder and B) the organ separator of A) modified to utilize cascading flared circular sections concentric with the outer cylinder.
Figure 3B:
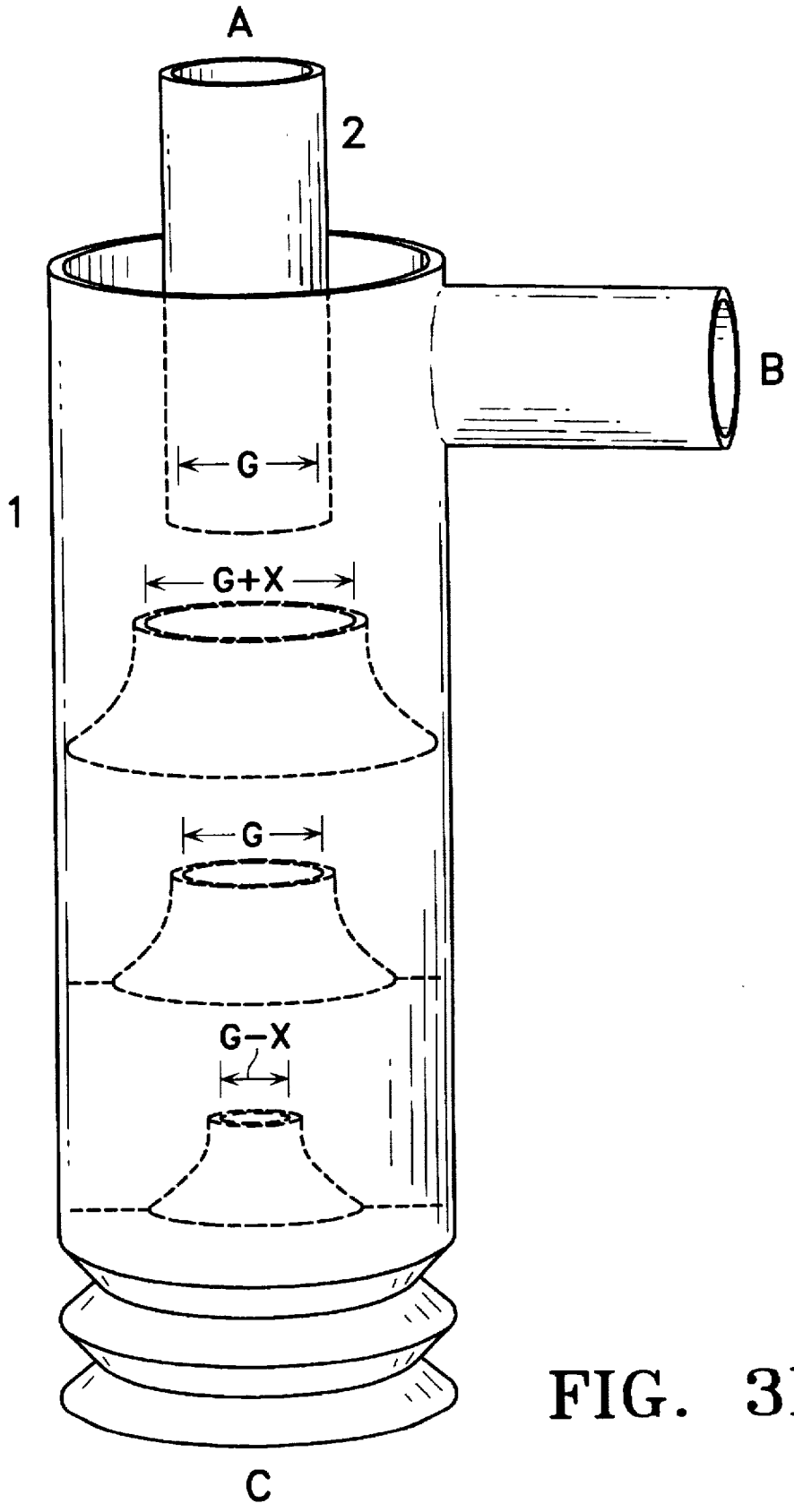
Figure 4B:
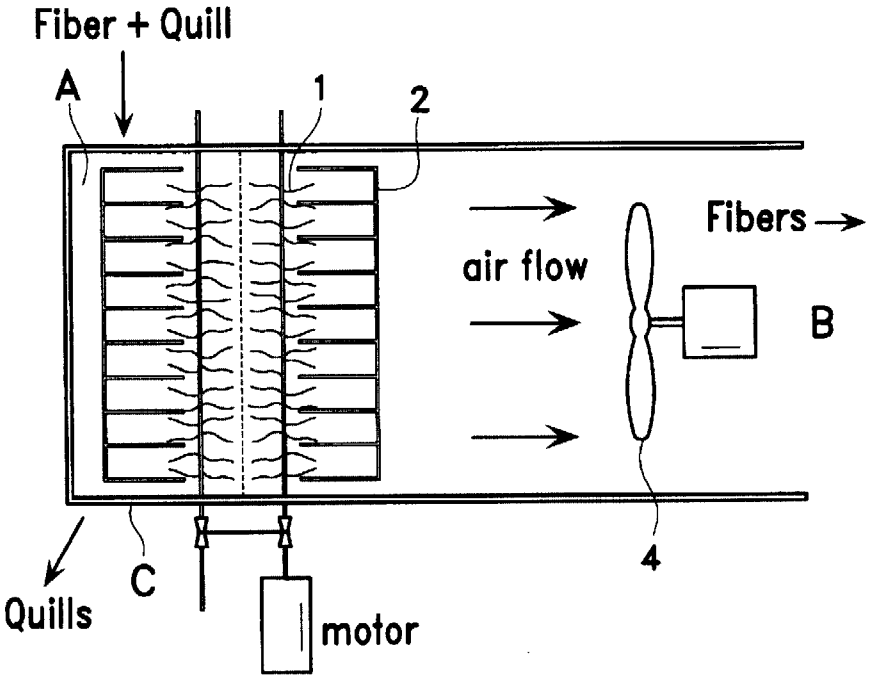
FIG. 4 is a drawing of a comb/brush separator (side and top views).
Figure 4A:
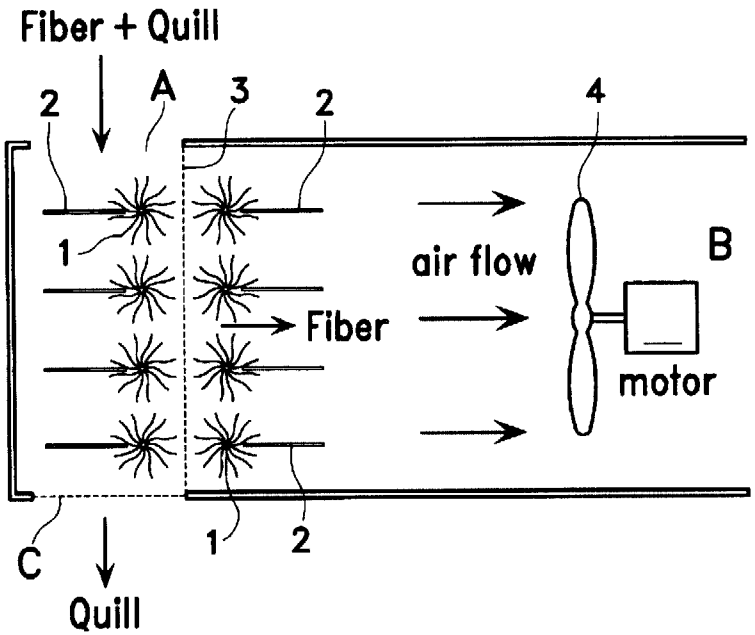

The organ separator, illustrated in FIG. 3A and 3B, is constructed essentially of two concentric hollow cylinders: an outer cylinder (1) and an inner input tube (2). The separator is air tight both at the bottom, where collection unit (C) is attached, and also air tight at the top, having an air tight seal between inner tube (2) and the outer cylinder (1). Air flows through the system by applying a vacuum at point B or by forcing air through point A. Alternatively, the system may also function effectively in reverse, i.e. by applying a vacuum at point A or by forcing air through point B.

The ground mixture of feather fibers and shaft particles are introduced into the separator through input tube A. The input tube is of sufficient length that all the particles reach the velocity of the air stream, and the airborne particles separate on the basis of air drag (D) and mass (M), i.e. the D/M ratio. When the particles of the mixture reach the end of the inner tube, they either tend to continue down into the air tight collection unit at C (heavier shaft particles) or go up at the outer cylinder and exit the system at B (lighter fiber particles). The critical factor in determining which path a particle will take depends upon whether its momentum at the end of the inner tube is too great for it to make the turn up the outer tube.

A modification of the organ separator, a single tube cascade (FIG. 3B), may be provided by replacing the lower portion of the inner tube with flared circular sections D concentric with the outer cylinder and stacked within the outer cylinder, each section acting as one separation stage. The circular sections are graduated in size, where G=the diameter of the inner input tube A.

The comb/brush separator, illustrated by FIG. 4, separates fibers from a mixture of feather fibers and shaft particles. The mixture is fed into the top inlet A, and the fibers are combed by the interaction of the rotary brushes 1 and combs 2. The mixture then transverses a vertical screen 3, and air pressure generated by a fan 4 pulls the fibers through the screen. Vertical openings in the screen section are sufficiently large to allow the fibers to pass through the screen but not the shaft particles. Brushes on both sides of the screen prevent the fibers from being trapped between the vertical openings and clogging the screen. The fibers exit through outlet B, while the larger shaft particles exit through the bottom outlet C.

Multi-unit configurations may be constructed by linking two or more separators, i.e., attaching outlet B to inlet A. The separators may be the same or different and may also be linked to the grinder to provide a continuous system. Other variables in the separation system include air flow velocity, air pressure and vacuum pressure. These parameters are easily adjusted depending upon conditions such as batch size and the size of the apparatus. Adjustment of these parameters are well within the level of skill in the art. The apparatus serve as illustrative examples of techniques which may be utilized to achieve effective separation of fiber from shaft material.

The fibers can be further treated by mechanical beating, for example with a Hollander beater, until the fibers are soft, pliable and supple. Variations in these properties as well as fiber length can be achieved as desired by modifying the beating and compression conditions. Alternatively, fibers may be subjected to chemical treatment with redox reagents such as 10% hydrogen peroxide for about 1 hour. At this point, they may be utilized for the production of products or further treated to produce pulp.

Coarse insulation can be produced from fibers obtained by shearing feathers, with both shafts and barbules present in the mixture. Fine insulation suitable for garments can be produced by removing the shaft material. Separating the shaft from barbule material also provides non-woven fibers useful, for example, in filter columns. Open-ended containers are packed with the fibrous material which is held in place by screens or membranes at either end. In addition, textiles are produced by spinning barbules into threads which are subsequently woven into fabric.

Fiber pulp is obtained by combining fibers with water and/or other wetting agents or additives selected so as to tailor the final product according to its ultimate use. Products of different types and qualities can be produced from the pulp by varying the particular additives utilized. Acceptable wetting agents are ionic and non-ionic surfactants, such as sodium dodecylsulfate and polysorbate 80.

Fiber pulp slurries are produced by mixing the pulp with water and/or other wetting agents in an amount sufficient for intended use. These slurries can then be adjusted to consistencies favorable for a variety of applications including extrusions, and the pressing and forming of objects of various shapes and sizes, e.g. trays, containers, vessels, tubes, frames or masts. Slurries can also be rolled and compressed into sheets and plates similar to particle board. Combination with appropriate foaming agents, such as Porofor® BSH, will produce a variety of lightweight filling materials for padding, packing and insulating. Fiber pulp slurries may also be used in the manufacture of non-woven fibers such as selective filters and general adsorbents.

Additives such as mordants and dyes (e.g., titanium dioxide and iron oxide); binders (e.g., starch and casein); foaming agents; hardeners; chemical sizing agents (e.g., a ketene dimer emulsion); fillers; and other plant (e.g., kenaf, cotton rag, wood cellulose) or animal (e.g., collagen) fibers may be used. These agents are known to those of skill in the art and can be varied according to the requirements for the ultimate product. Chemical cross-linking, wetting and/or redox reagents may also be utilized as needed.

Existing techniques and technologies may be utilized to manufacture the products of interest. The procedures are well-known in the art, and the fiber pulp described fits directly into productions schemes already established. Paper products are made as outlined by Smook, G. A. (*Handbook for Pulp & Paper Technologists*. 1989. Canadian Pulp and Paper Association, Montreal) or Clark, J d'A. (*Pulp Technology and Treatment for Paper*, 2nd ed. 1985. Miller Freeman Publications, Inc., San Francisco) for printing grades, industrial grades, specialty grades and tissue paper. Corrugated materials such as cardboard are made directly from paper products in existing corrugation machinery according to Higham, R. R. A. (*A Handbook of paperboard and Board*. 1970. Vol. I: Manufacturing Technology; and 1971. Vol. II: Technology of Conversion and Usage, Business Books Limited, London) or Chamberlain, M. R. and Bowler, J. F. (*Dictionary of converting*. 1992. Blackie Academic & Professional, London). Fiber pulp slurry is adjusted to consistencies effective for extrusion or pressing and forming various shaped and sized objects such as trays, containers, vessels, tubes, frames or masts according to Higham or Chamberlain and Bowler, supra. Fiber pulp is rolled and compressed into sheets and plates such as particle board. Fiber pulp is combined with appropriate foaming agents to produce a variety of light weight filling materials for padding, packing and insulating. Fiber pulp can also be used to manufacture selective filters and general adsorbents as described by Nachinkin, O. I. (*Polymeric Microfilters*. 1991. Ellis Horwood, N.Y.).

The following examples are intended only to further illustrate the invention and are not intended to limit the scope of the invention as defined by the claims.

EXAMPLES

Example 1

Preparation of Fibers

Ten grams of feathers are washed and sanitized in 500 ml 95% ethanol with agitation for one hour. The washed feathers are removed from the wash solution and further washed and sanitized in 500 ml 70% ethanol for one hour. After draining off the second wash solution, the feathers are dried, then passed through a commercial Wiley mill containing a 10 mesh screen. The resulting material is then passed through the Wiley mill containing a 20 mesh screen.

Example 2

Preparation of Fiber Pulp

About 5 g commercial casein glue (Elmer's Glue, Borden Co., Columbus, Ohio) is added to 5 g water and mixed, followed by the addition of 10 g ethanol. The solution is sonicated to remove air bubbles and mixed with 10 g fibers prepared as described in Example 1 to form a fiber pulp slurry.

Example 3

Preparation of Paper from Fiber Pulp

A slurry prepared according to Example 2 is spread evenly over a thin 12"×12" polyethylene plastic sheet overlaid onto an 11"×11"×¼" plexiglass plate with a spatula, tamped even with a 12"×1"×⅛" straight-edge, and allowed to air dry overnight. A mist of ethanol is sprayed onto the sheet, and the sheet is allowed to dry under about 0.5 to 10 ton pressure per square inch in a hydraulic press between two polyethylene lined plexiglass sheets. After pressing, the polyethylene sheets are removed from the product. This process is sufficient to produce an 8½"×11" sheet of paper.

Example 4

Preparation of Composite from Fiber Pulp

After washing, sanitizing and drying as described in Example 1, 5 g feathers are placed in a high speed commercial Waring blender and sheared for 2.5 min. A shaft-free fraction of fiber is obtained by passing the mixture through a small 6" fan blowing into a 2'×2'×10' box made of household screening. Fiber which carries more than 8' is collected. One pound of this fiber fraction is placed in a Hollander beater containing about 0.5 ml Tween in 20 gal water and beaten for 3 hrs. The beaten fiber pulp slurry is collected. [NOTE: Optionally the fiber is chemically treated with hydrogen peroxide to further whiten the fibers and to enhance the pulp-like properties of the fiber.] The sample is dried overnight in a forced-air oven at 105° C. About 8 g dried fiber pulp is beaten with 2 g kenaf, 0.5 g casein glue solution and 300 ml water in a Waring blender for 5 min. The pulp slurry is poured onto a thin 12"×12" polyethylene plastic sheet and overlaid onto an 11"×11"×¼" plexiglass plate. The slurry is spread evenly over the polyethylene sheet with a spatula and tamped even with a 12"×1"×⅛" straight-edge. The slurry is allowed to air dry overnight. A mist of ethanol is sprayed onto the sheet, and the sheet is allowed to dry under about 0.5–10 ton pressure per square inch in a hydraulic press between two polyethylene lined plexiglass sheets. The polyethylene is removed from the product, a flat composite sheet of feather/kenaf fiber.

While the above Examples describe procedures carried out by hand, mechanized procedures are preferable for mass production. These procedures are described in the above-cited references, all of which are herein incorporated by reference, and fiber and fiber pulp compositions may be utilized in these procedures with little or no modification.

We claim:

1. A method of making fiber from feathers, said method comprising:

a) collecting raw feathers, b) washing said feathers in a polar water soluble organic solvent, c) carring out an additional washing step, d) removing solvent from said feathers, and e) removing fibers from the feather shafts of said feathers.

2. The method of claim 1, wherein said washing step b) is carried out for about one hour.

3. The method of claim 1, wherein said polar water soluble organic solvent is ethanol.

4. The method of claim 3, wherein said ethanol is about 95% ethanol.

5. The method of claim 1, wherein said washing step b) is carried out at a ratio of about 1.0 to about 1.5 gallons of said polar water soluble organic solvent to one pound of feathers.

6. The method of claim 1, wherein said polar water soluble organic solvent additionally comprises a surfactant.

7. The method of claim 1, wherein said washing step c) is carried out in polar water soluble organic solvent.

8. The method of claim 7, wherein said polar water soluble organic solvent is ethanol.

9. The method of claim 8, wherein said ethanol is about 70% ethanol.

10. The method of claim 7, wherein said polar water soluble organic solvent is a bactericidal agent.

11. The method of claim 10, wherein said bactericidal agent is sodium azide solution.

12. The method of claim 1, wherein said washing step c) is carried out in a mixture of ethanol and bactericidal agent.

13. The method of claim 1, wherein said washing step c) is carried out at a ratio of about 1.0 to about 1.5 gallons of solvent to one pound of feathers.

14. The method of claim 1, wherein said solvent removal step is carried out by heating said fibers at about 60° C. to about 120° C.

15. The method of claim 1, wherein said fibers are removed from feather shafts by mechanical shredding or shearing.

16. The method of claim 1, wherein said method additionally comprises a step of separating fiber material from shaft material after the removal of fibers from shafts.

17. The method of claims 1 or 16, wherein said method additionally comprises a step wherein the fibers are subjected to treatment to render them soft and pliable, said additional step being carried out subsequent to removal of the fibers from the feather shafts or subsequent to separation of the fibers from the shaft particles.

18. The method of claim 17, wherein said treatment is beating or chemical treatment with a redox reagent.

19. The method of claim 18, wherein said redox reagent is hydrogen peroxide and water.

20. The method of claim 1, wherein said fibers are removed from feather shafts by grinding mulching or chopping resulting in a mixture of feather fiber and shaft particles.

21. The method of claim 20, wherein said method additionally comprises a step of separating feather fibers from shaft particles.

22. The method of claim 21, wherein said separating step is carried out using a linter, a cone separator, an organ separator or a comb/brush separator.

23. The method of claim 21, wherein said separating step is carried out using a combination of at least two of a linter, a cone separator, an organ separator and a comb/brush separator linked together by attaching the outlet from a first separator to the inlet of a following separator.

24. The method of claim 21, wherein said method additionally comprises treating the fibers-to soften them.

25. The method of claim 24, wherein said treating step is beating or chemical treatment with a redox reagent.

26. The method of claim 25, wherein said redox agent is hydrogen peroxide and water.

27. Fibers derived from feathers, wherein said fibers are prepared according to a method comprising a) collecting raw feathers, b) washing said feathers in a polar, water-soluble organic solvent, c) repeating said washing step, d) removing solvent from said feathers, and e) removing fibers from feather shafts;

said fibers having been subjected to treatment to render them soft and pliable, wherein said treatment is beating or chemical treatment with redox reagents.

28. The fibers of claim 27, wherein said redox reagent is hydrogen peroxide and water.

29. A method of making fiber pulp, said method comprising mixing fibers derived from feathers with an amount of water or wetting agents effective for the preparation of said fiber pulp, wherein said fibers are prepared according to a method comprising a) collecting raw feathers.

b) washing said feathers in a polar, water-soluble organic solvent.

c) repeating said washing step, d) removing solvent from said feathers, and e) removing fibers from feather shafts;

said fibers having been subjected to treatment to render them soft and pliable, wherein said treatment is beating or chemical treatment with redox reagents.

30. A method of making fiber pulp, said method comprising mixing fibers derived from feathers with an amount of water and wetting agents effective for the preparation of said fiber pulp, wherein said fibers are prepared according to a method comprising a) collecting raw feathers, b) washing said feathers in a polar water-soluble organic solvent, c) repeating said washing step, d) removing solvent from said feathers, and e) removing fibers from feather shafts:

said fibers having been subjected to treatment to render them soft and Pliable, wherein said treatment is beating or chemical treatment with redox reagents.

31. A composition comprising fibers derived from feathers and one or more additives, wherein said fibers are prepared according to a method comprising a) collecting raw feathers, b) washing said feathers in a polar, water-soluble organic solvent, c) repeating said washing step, d) removing solvent from said feathers and e) removing fibers from feather shafts;

said fibers having been subjected to treatment to render them soft and pliable, wherein said treatment is beating or chemical treatment with redox reagents.

32. The composition of claim 31, wherein said additives are selected from the group consisting of adhesives, binders, sizing agents, dyes, mordants fillers, plant fibers, animal fibers and whiteners.

33. A composition comprising fiber pulp, wherein said fiber pulp comprises fiber derived from feathers and water or wetting agents, and wherein said fibers are prepared according to a method comprising a) collecting raw feathers, b) washing said feather in a polar, water-soluble organic solvent, c) repeating said washing step, d) removing solvent from said feathers, and e) removing fiber from feather shafts;

said fibers having being subjected to treatment to render them soft and pliable, wherein said treatment is beating or chemical treatment with redox reagents.

34. A composition comprising fiber pulp, wherein said fiber pulp comprises fibers derived from feathers, water and wetting agents and wherein said fibers are prepared according to a method comprising a) collecting raw feathers, b) washing said feathers in a polar, water-soluble organic solvent, c) repeating said washing step, d) removing solvent from said feathers, and e) removing fibers from feather shafts;

said fibers having been subjected to treatment to render them soft and pliable, wherein said treatment is beating or chemical treatment with redox reagents.

35. The composition of claims 33, or 34, wherein said composition additionally comprises additives selected from the group consisting of mordants, dyes, binders, foaming agents, hardeners, chemical sizing agents, fillers, plant fibers and animal fibers.

* * * * *